US007383011B2

(12) United States Patent
Omata

(10) Patent No.: US 7,383,011 B2
(45) Date of Patent: Jun. 3, 2008

(54) IMAGE FORMING APPARATUS FEATURING A PRE-SMOOTHENING MODE PERFORMED PRIOR TO FORMATION OF A TONER IMAGE

(75) Inventor: Haruhiko Omata, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 289 days.

(21) Appl. No.: 11/140,740

(22) Filed: Jun. 1, 2005

(65) Prior Publication Data

US 2005/0271409 A1 Dec. 8, 2005

(30) Foreign Application Priority Data

Jun. 4, 2004 (JP) ..... 2004-166795

(51) Int. Cl.
*G03G 15/20* (2006.01)

(52) U.S. Cl. ..... 399/329

(58) Field of Classification Search ..... 399/329; 219/216

See application file for complete search history.

(56) References Cited

U.S. PATENT DOCUMENTS 4,138,522 A * 2/1979 Ishizuka et al. ..... 428/195.1
6,526,250 B1 * 2/2003 Usui et al. ..... 399/307
2004/0175208 A1 * 9/2004 Ichida et al. ..... 399/302
2006/0127143 A1 * 6/2006 Tamura et al. ..... 399/329
2007/0122216 A1 * 5/2007 Omata ..... 399/329

FOREIGN PATENT DOCUMENTS

| | | |
|---|---|---|
| EP | 0 301 585 A2 | 2/1989 |
| JP | 64-35452 | 2/1989 |
| JP | 4-216580 | 8/1992 |
| JP | 4-362679 | 12/1992 |
| JP | 5-216322 | 8/1993 |
| JP | 2001-117386 | 4/2001 |
| JP | 2003-84477 | 3/2003 |

* cited by examiner

*Primary Examiner*—Quana M Grainger
(74) *Attorney, Agent, or Firm*—Fitzpatrick, Cella, Harper & Scinto

(57) ABSTRACT

An image forming apparatus including image forming means for forming a toner image on a toner reception resin layer of a recording medium; conveying means for conveying the recording medium set on a setting portion to the image forming means; and smoothening means for smoothening the toner reception resin layer of the recording medium on which the toner image is formed by the image forming means. The apparatus is operable in a pre-smoothening mode in which the toner reception resin layer of the recording medium is smoothened before the toner image is formed on the toner reception resin layer of the recording medium.

9 Claims, 7 Drawing Sheets

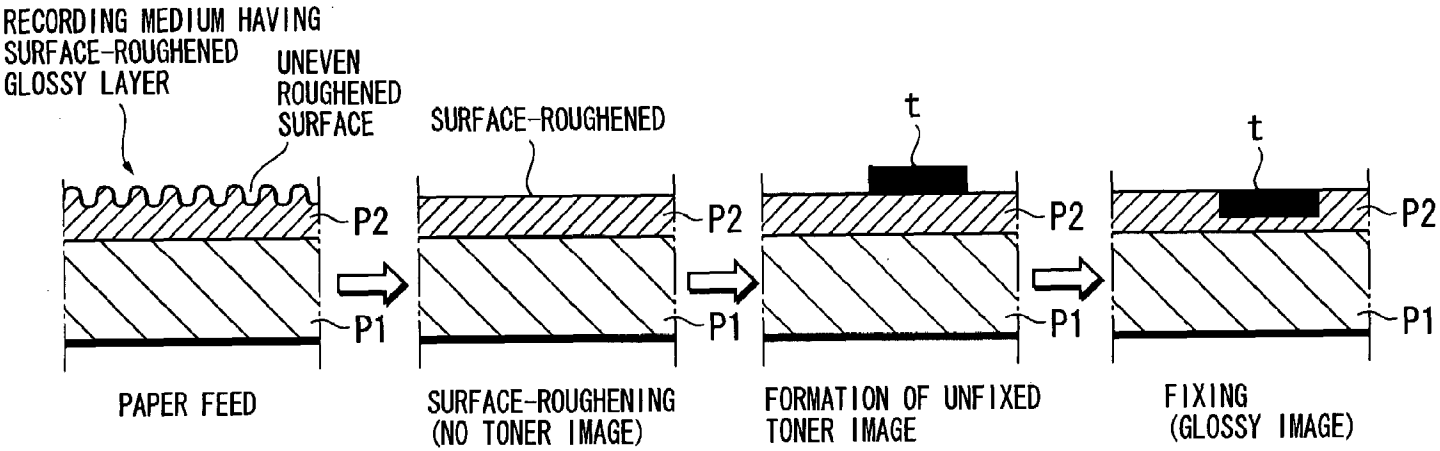
FIG.5A
RECORDING MEDIUM HAVING SURFACE-ROUGHENED GLOSSY LAYER
UNEVEN ROUGHENED SURFACE
P2
P1
PAPER FEED
FIG.5B
SURFACE-ROUGHENED
P2
P1
SURFACE-ROUGHENING (NO TONER IMAGE)
FIG.5C
t
P2
P1
FORMATION OF UNFIXED TONER IMAGE
FIG.5D
t
P2
P1
FIXING (GLOSSY IMAGE)
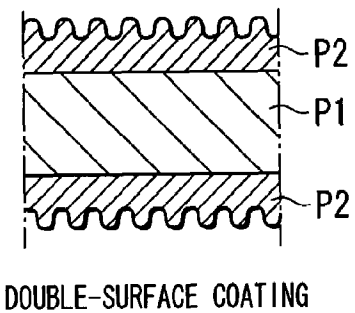
FIG.5E
P2
P1
P2
DOUBLE-SURFACE COATING

IMAGE FORMING APPARATUS FEATURING A PRE-SMOOTHENING MODE PERFORMED PRIOR TO FORMATION OF A TONER IMAGE

BACKGROUND OF THE INVENTION

1. Field of the Invention

The present invention relates to an image forming apparatus utilizing an electrophotographic system, and in particular, to an image forming apparatus such as a copying machine, a printer or a facsimile unit.

2. Description of the Related Art

Heretofore, there have been widely well-known an image forming apparatus mainly utilizing an electrophotographic system, such as a copying machine or a printer. Monochromatic image forming apparatuses as well as full color image forming apparatuses are now widely and commercially available. Further, as the image forming apparatus of the electrophotographic type has been used in various fields, demands for the image quality thereof have been higher.

It is noted that a degree of smoothness of an output image may be one of the factors which can determine a quality of an image, that is, a degree of glossiness of a full color image. For example, in order to comply with the above-mentioned demands, Japanese Patent Laid-Open No. S64-35452 or Japanese Patent Laid-Open No. H05-216322 discloses an image forming method of forming a color image bearing product having a high degree of glossiness, in which a recording medium coated thereover with a transparent resin layer, as a glossy layer, made of thermoplastic resin is transferred thereon with an unfixed color toner image made of thermoplastic resin, and then is heated so as to fuse the color toner image in order to fix the same.

In the above-mentioned image forming method, a belt fixing unit has been proposed for desired fixation. For example, a belt fixing unit disclosed in Japanese Patent Laid-Open No. H04-216580 or Japanese Patent Laid-Open No. H04-362679 has such a configuration that a recording medium carrying thereon a unfixed toner image is pressed and heated by a fixing belt made of a heat-resistance film having a smooth surface, then is cooled while it is held in close contact with the fixing belt in order to solidify the toner image. Thereafter, the recording medium to which the toner image is fixed is separated from the fixing belt. As a result, the toner image is fixed while being embedded in the transparent resin layer of the recording medium and while the transparent resin layer on the surface of the recording medium and the toner image are both fixed copying the surface configuration of the belt. Accordingly, the entire surface of the recording medium becomes smoother. Thereby, it is possible to obtain a color image which is excellent in glossiness.

Further, a recording medium having a resin layer as a glossy layer is proposed in Japanese Patent Laid-Open No. 2003-084477 which thus discloses an electrophotographic image transfer sheet coated thereover with a resin layer made of, for example, thermoplastic resin, as a main component, having a glass transition temperature of not higher than 85 deg. C. and having a thickness of about 20 μm.

However, as stated above, the glossy image forming method in which a toner image is formed on a recording medium having the glossy layer on its surface, and is fixed by the belt fixing unit so as to obtain a glossy image medium would possibly causes the following problems:

1) First, should the original surface of the glossy layer of the recording medium be unsmooth, the belt fixing unit should apply a heat and a pressure which are required for enabling the glossy layer of the recording medium to have a required smooth surface. That is, the lower the degree of smoothness of the surface of the glossy layer of the recording medium before image formation, higher heat and pressure are required.

However, should the heat value and the degree of pressure of the belt fixing unit be increased, the toner image and the resin layer as the gloss layer would be subjected to heat and pressure which are accordingly high. As a result, the heat and the pressure which are excessive, would cause the toner to be excessively fused so as to be offset onto a fixing belt or to flow over the surface of the recording medium, resulting in a problem of blurring of the toner image, and further, to deviate the toner image together with the resin layer as the glossy layer of the recording medium, resulting in a problem of disturbance of the toner image.

Thus, in the case of a low degree of smoothness of the surface of the glossy layer of the recoding medium before image formation, it is self-explanatory that there is a limitation in increase of heat and pressure of the belt fixing unit for enabling the surface of the glossy layer to have a desired smooth surface.

2) Accordingly, although it is preferable to allow the surface of the glossy layer of the recoding medium to be previously smooth before using, the recoding medium of such kind would possibly cause an occurrence of a problem of double feeding of the recording medium when one sheet of the recoding medium which has been stacked in a paper feed portion is separated from the other sheets of the recording medium and is fed.

That is, in the case of fixing a unfixed toner image on a recording medium having at its one surface a glossy layer, there have been raised the above-mentioned technical problems.

SUMMARY OF THE INVENTION

An object of the present invention is to provide an image forming apparatus capable of forming a satisfactory glossy image.

Another object of the present invention is to provide an image forming apparatus having conveying performance of a recording medium and glossiness of an image which are both satisfactory.

To this end, according to a first aspect of the present invention, there is provided an image forming apparatus comprising an image forming means for forming an image on a recording medium, a conveying means for conveying a recording medium set in a recording medium setting portion to the image forming means and a smoothening means for smoothing a surface of the recording medium, wherein when a glossy image is to be formed on the recording medium formed on its surface with a resin layer, the surface of the recording medium is smoothened by the smoothening means before the image is formed on the recording medium by the image forming means.

According to a second aspect of the present invention, there is provided an image forming means for forming an image on a recording medium, a fixing means for fixing the image formed by the image forming means, on the recording medium, and a smoothening means for smoothening a surface of the recording medium wherein the image forming apparatus incorporates glossy image forming mode for smoothening the surface of the recording medium by the smoothening means before the image is formed by the image forming means, on the recording medium having, on its surface, a resin layer.

Further features and advantages of the present invention will become apparent from the following description of exemplary embodiments with reference to the attached drawings.

BRIEF DESCRIPTION OF THE DRAWINGS

FIGS. 5A to 5E are sectional views illustrating progressing steps in a glossy image forming mode in a second embodiment of the present invention;

DESCRIPTION OF THE EMBODIMENTS

Embodiment 1

Figure 1:
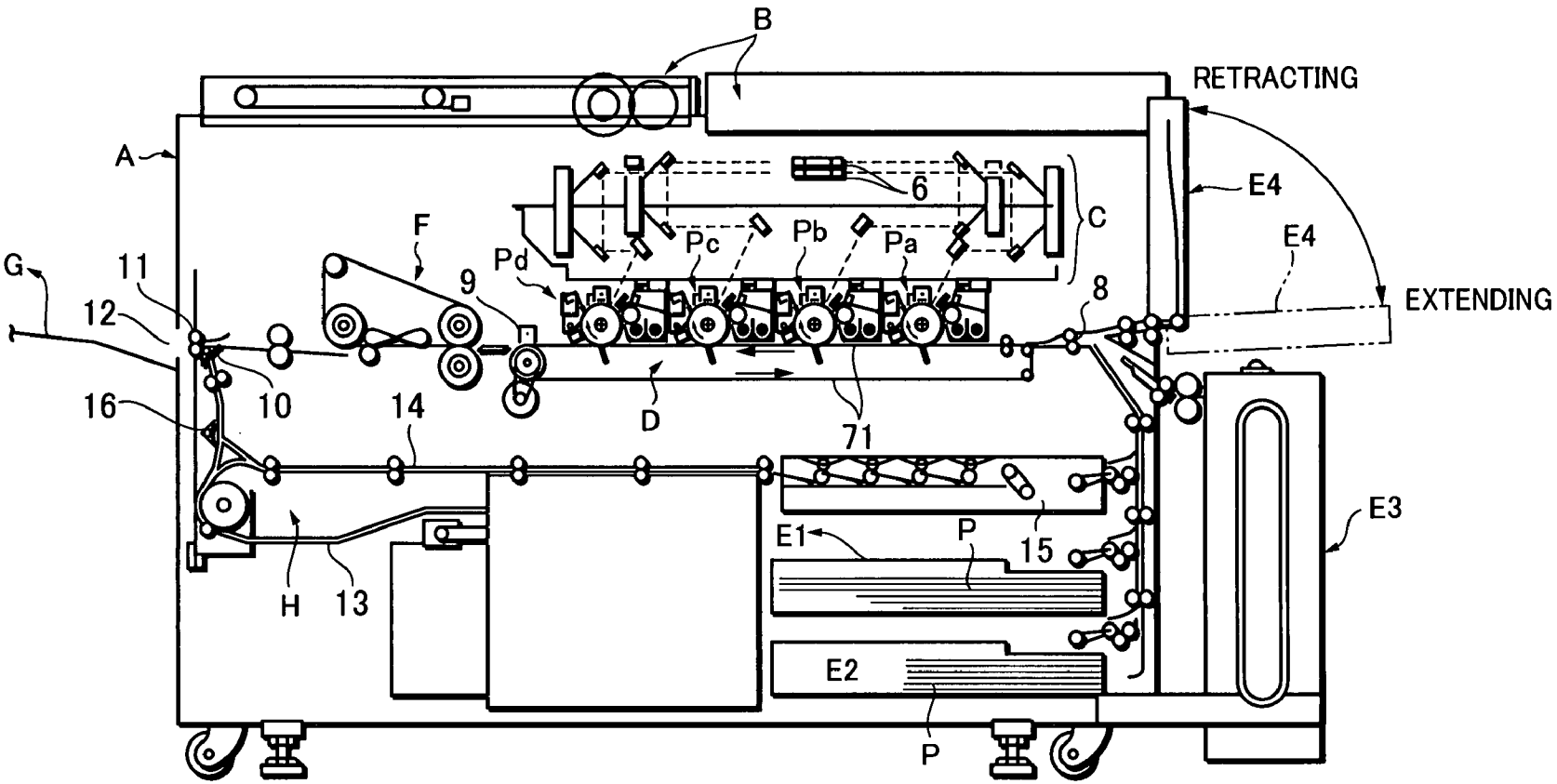
FIG. 1 is a schematic sectional view illustrating a basic configuration of an image forming apparatus in a first embodiment of the present invention.
Figure 2:
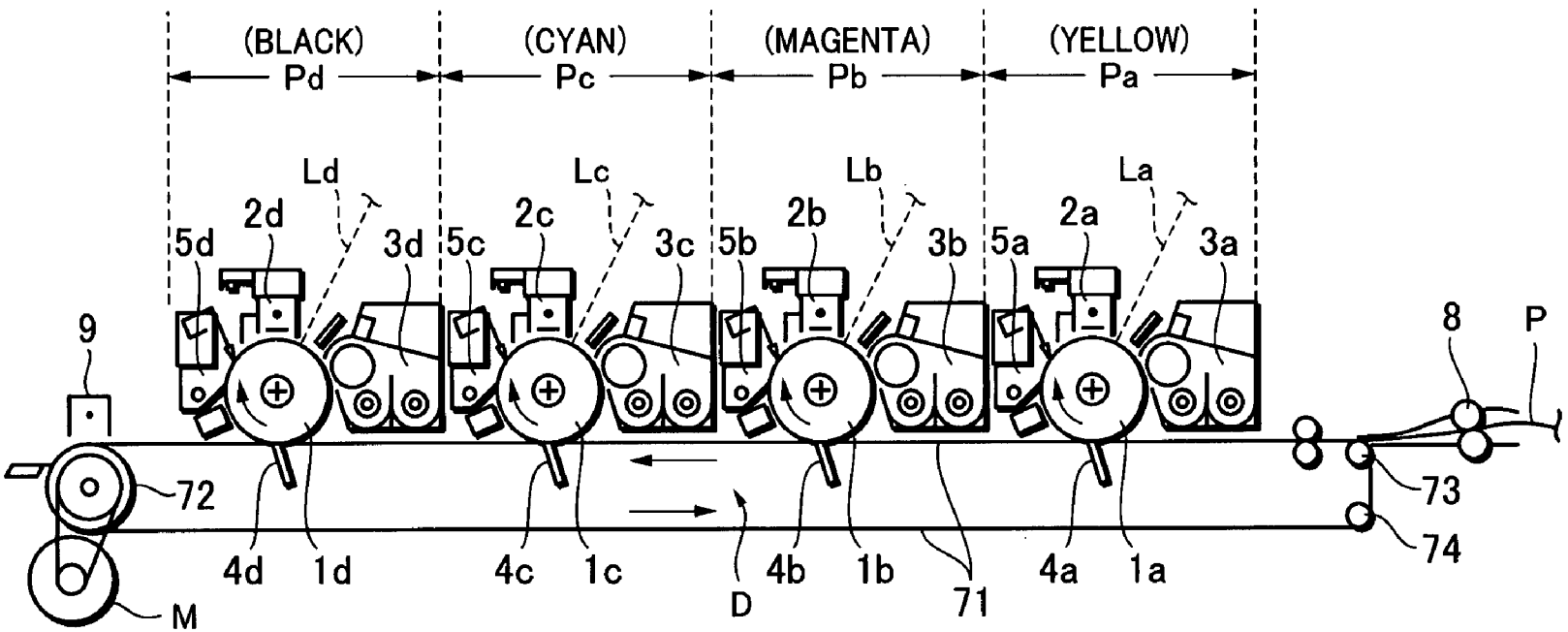
FIG. 2 is an enlarged sectional view illustrating an essential part of the image forming apparatus shown in FIG. 1.

(1) An Example of an Image Forming Apparatus:

FIG. 1 is a schematic sectional view which shows a basic configuration of an example of an image forming apparatus according to the present invention, and FIG. 2 is a enlarged sectional view which shows an essential portion of the image forming apparatus shown in FIG. 1.

The image forming apparatus in this embodiment is a full color laser printer of a four-color, toner type (a four drum laser printer having a plurality of optical scanning means).

The image forming apparatus is provided therein with a transfer belt mechanism D having an endless transfer belt 71 as a recording medium carrier for carrying on its surface a recording medium P. Image forming portions Pa, Pb, Pc, Pd as four image forming means, are arranged above the transfer belt 71 in the mentioned order as viewed from the upstream side, along a belt rotating direction. The first image forming portion Pa forms an yellow toner image, the second image forming portion Pb forms a magenta toner imager, the third image forming portion Pc forms a cyan toner image and the fourth image forming portion Pd forms a black toner image.

In a reader portion B located on the upper surface side of a printer body A, an image information on an original color copy is subjected to a process of color separation and reading by optical conversion elements, such as CCDs or the like. Laser beams La, Lb, Lc, Ld which are modulated, corresponding to the image information to be color-separated and read, are emitted from a laser scanning portion C including a plurality of optical scanning means.

Further, the image forming portions Pa, Pb, Pc, Pd are applied thereto with an electrophotographic process including a step of scanning and exposing photosensitive drums 1*a*, 1*b*, 1*c*, 1*d* which are rotated respectively at predetermined speeds, respectively with the laser beams La, Lb, Lc, Ld emitted from the above-mentioned laser scanning portion C. Accordingly, a yellow toner image is formed on the photosensitive drum 1*a* in the first image forming portion Pa, a magenta toner image is formed on the photosensitive drum 1*b* in the second image forming portion Pb, a cyan toner image is formed on the photosensitive drum 1*c* in the third image forming portion Pc, and a black toner image is formed on the photosensitive drum 1*d* in the fourth image forming portion Pd. The color toner images, that is, the yellow, magenta, cyan and black toner images, which have been formed on the photosensitive drums are successively transferred, being superposed with one another, onto the recoding medium (transferring medium) P which is held and conveyed on the transfer belt 71 in the transfer belt mechanism D. Accordingly, it is possible to synthesize a full color toner image with four color toners on the recording medium P.

In the respective first to fourth image forming portions Pa, Pb, Pc, Pd, charge units 2*a*, 2*b*, 2*c*, 2*d*, developing units 2*a*, 2*b*, 2*c*, 2*d* and cleaners 5*a*, 5*b*, 5*c*, 5*d* are arranged respectively around the photosensitive drums 1*a*, 1*b*, 1*c*, 1*d* in the mentioned order along a rotating direction of the photosensitive drums.

The laser scanning portion C having a plurality of optical scanning means is provided therein with light source units (which are not shown) and polygon mirrors 6. Scanning is performed by the laser beams emitted from the light source units by rotating the polygon mirrors 6. The scanning beams are deflected by reflection mirrors, and are then focused by fθ lenses on the respective generating lines on the on the photosensitive drums 1*a*, 1*b*, 1*c*, 1*d* in the image forming portions Pa, Pb, Pc, Pd, for exposing the photosensitive drums 1*a*, 1*b*, 1*c*, 1*d* on which electrostatic latent images are therefore formed in accordance with image signals.

The developing units 3*a*, 3*b*, 3*c*, 3*d* in the respective image forming portions Pa, Pb, Pc, Pd are charged with yellow, magenta, cyan and black dry toners as developers from supply devices by predetermined quantities. The respective developing units are those for which a dry-type developing process is used. Thus, the latent images on the respective photosensitive drums are developed with the color toners, and accordingly, a yellow toner image, a magenta toner image, a cyan toner image and a black toner image are visualized.

In the transfer belt mechanism D, the transfer belt 71 is formed of a dielectric resin sheet, such as a polyethylene terephthalate resin sheet (PET resin sheet), a polyvinylidene fluoride resin sheet or a polyurethane resin sheet, having opposite end parts which are superposed and joined with each other so as to form an endless belt, or is formed of a seamless belt with no joint. The endless transfer belt 71 is suspended and stretched among three rollers, that is a drive roller 72 and turn rollers 73, 74. Accordingly, the drive roller 72 is rotated by a drive motor M so as to transmit drive rotation through the intermediary of a power transmission mechanism, such as a timing belt unit so as to rotate the transfer belt 71 at a predetermined speed in a counterclockwise direction.

Transfer chargers 4*a*, 4*b*, 4*c*, 4*d* which are brought into press contact with the lower surfaces of the photosensitive drums 1*a*, 1*b*, 1*c*, 1*d*, respectively, through the intermediary of the upper running belt part of the transfer belt 71. In each of the image forming portions, a contact part between the photosensitive drum and the transfer belt is a transcription part.

Paper feed cassettes E1, E2 as recording medium setting portions are located in the printer body A. A large capacity paper feed unit E3 as a recording medium setting portion is contiguous to and combined with the printer body A. A manual insertion paper feed tray is a recording medium setting portion. The manual insertion paper feed tray E4 may be retracted as indicated by the solid line, so as to be storable in the printer body A. This manual insertion tray is extended as indicated by the two-dot chain line during a use thereof, and a plurality of sheets of recording medium can be set therein at the same time.

Each of the paper feed portions E1 to E4 is provided therein with paper feed rollers as conveying means for selectively separating and conveying a single sheet of recording medium P which is located at a topmost surface of stacked sheets of recording medium set therein, and which is brought into contact with the rollers, toward the image forming portions.

Further, by rotating the paper feed rollers in a selected and designated one of the paper feed portions E1 to E4, a recording medium P at the topmost sheet of the stacked recording medium set therein is selectively separated. Then, the separated recording medium is fed onto the transfer belt 71 in the transfer belt mechanism D by way of a plurality of conveying rollers and registration rollers 8, and is fed successively to the first to fourth image forming portions Pa, Pb, Pc, Pd by being conveyed by the transfer belt 71.

After the transfer belt 71 in the transfer belt mechanism D is rotated by the drive roller 72, and when it is confirmed that the transfer belt 71 is located at a predetermined position, the recording medium P is fed out from the registration rollers 8 onto the transfer belt 71, and is then conveyed to the transcription part of the first image forming portion Pa. Simultaneously, an image write signal is energized, image formation is carried out on the first drum 1*a* in the first image forming portion Pa with a certain timing with reference to the energization of the image write signal. Then, the transfer charger 4*a* in the transcription part underneath the photosensitive drum 1*a* applies an electric field or an electric charge. Accordingly, a yellow toner image as a first cooler image formed on the first drum 1*a* is transferred onto the recoding medium P. Due to this transcription, the recording medium P is firmly held by the transfer belt 71 through electrostatic attraction, and is then conveyed to the second image forming portions Pb, Pc, Pd, successively. That is, the recording medium P carried on the transfer belt 71 is conveyed successively to the transcription parts of the first to fourth image forming portions Pa, Pb, Pc, Pd, and is transferred thereon successively with the yellow, magenta, cyan and black toner images which have been formed on the photosensitive drums and which are therefore superposed with one another. Thus, a full color toner image with four color toners is synthesized on the recording medium P.

The recording medium P on which the full color toner image with four color toners is synthesized and formed is electrically discharged by a separation charger 9 on the downstream part of the transfer belt 71 in the conveying direction thereof so as to attenuate the electrostatic attraction. Accordingly, the recording medium P is separated from the distal end of the transfer belt 71. In particular, since the recording medium P is dried in a low humidity atmosphere so as to increase an electric resistance, resulting in increased electrostatic attraction to the transfer belt 71, the effect by the separation charger 9 becomes larger. Usually, the separation charger 9 charges the recoding medium P in a condition in which a toner image has not yet been fixed, and accordingly, a non-contact type charger is used therefor.

The recording medium P separated from the transfer belt 71 is conveyed to a fixing unit F in which it is heated and pressed so as to carry out the color mixture of the respective color toner images and fixing (fixation) of the toner images onto the recording medium P. Thus, a full color image bearing product is obtained.

In the case of selection of a single surface image forming mode, the recording medium P having come out from the fixing unit F runs over the upper side of the selector 10 which is held in a first posture, and is then discharged by discharge rollers 11 onto an external discharge tray G through a discharge port 12.

In the case of selection of a double surface image forming mode, the recording medium P having come out from the fixing unit F and having its fixed first surface, is guided by the selector 10 whose posture has been changed over into a second posture, so that its advancing direction is changed toward a reverse refeed mechanism H. Further, it is reversed upside down in a reversing part (switch-back mechanism) 13 in the reverse refeed mechanism H, and is then fed onto a double surface conveying path 14 for an intermediate tray 15 where it is once stored. The recording medium P stored in the intermediate tray 15 is fed out by paper feed rollers which are rotated with a predetermined timing, from the intermediate tray 15 to the registration rollers 8 from which the recording medium is fed onto the transfer belt 71 in the transfer belt mechanism D with its second surface facing up. Thus, a full color image with four color toners is synthesized, similar to the image formation on the first surface thereof, by the image forming portions Pa, Pb, Pc, Pd.

The recording medium P having the second surface which has been subjected to toner image formation is separated from the transfer belt 71 and is then conveyed to the fixing unit F in which the full color toner image is fixed on the second surface in the fixing unit F. Thereafter, the recording medium P passes over the upper side of the selector 10 having been changed over into the first posture, and is discharged by the discharge rollers 11 onto the external discharge tray G through the discharge port 12, as a double-surface image bearing product.

The image forming apparatus can produce a monochromatic image bearing product or a single color image bearing product. In this case, when an image forming mode therefore is selected, only one of the first to fourth image forming portions Pa, Pb, Pc, Pd, which has been selected, corresponding to the image forming mode, is operated for image formation, but the other image forming portions are not operated. Although the photosensitive drums thereof are rotated. Thus, in the transfer part of the image forming portion which has been operated for image formation, sequence for transferring a toner image onto a recording medium conveyed by the transfer belt mechanism D is carried out.

(2) Fixing Unit F

Figure 3:
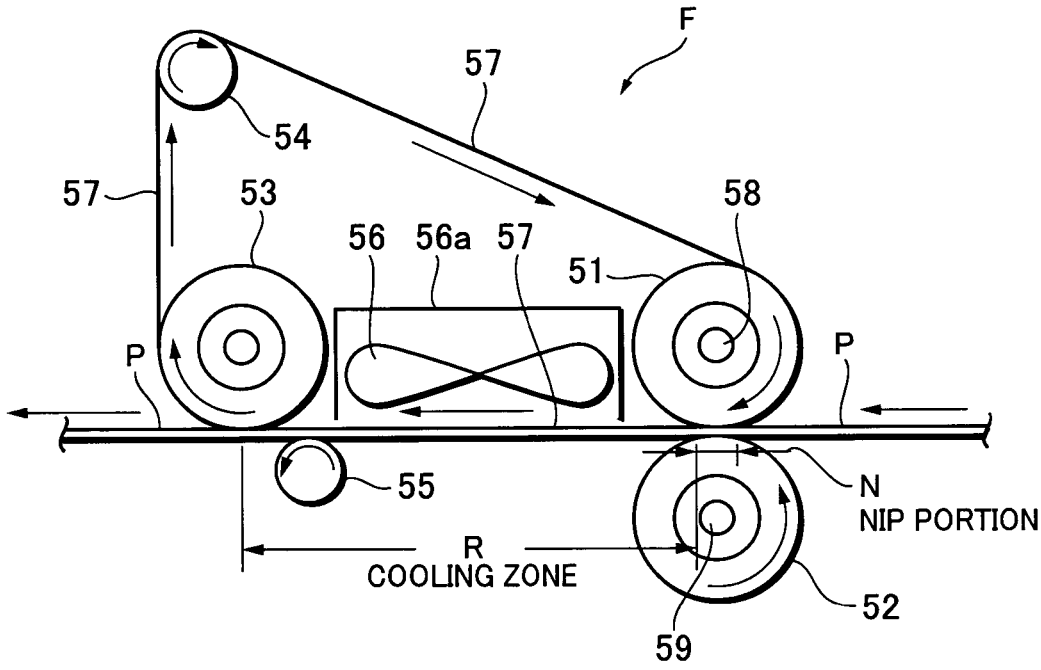
FIG. 3 is an enlarged sectional view illustrating a fixing portion (belt fixing unit)

FIG. 3 is a schematic enlarged sectional view which shows a basic configuration of the fixing unit F. The fixing unit F in this embodiment is a belt fixing unit which is composed of a first fixing roller (which will be hereinbelow referred to as "fixing roller") 51, a rotating roller (which will be hereinbelow referred to as "separating roller") 53 as a separating roller spaced from the fixing roller 51 by a predetermined distance, a rotating roller (which will be hereinbelow referred to as "tension roller") 54 as a tension roller located above the separating roller 53, the endless fixing belt 57 suspended and stretched among these three rollers 51, 53, 54, a second fixing roller (which will be hereinbelow referred to as "press roller") 53 as a press roller opposed to the fixing roller 51 with the fixing belt 57 being held therebetween and made into press contact with the fixing roller 51, an auxiliary roller 55 abutting against the outer surface of the fixing belt 57 in a part between the fixing roller 51 and the separating roller 53, at a position which is nearer to the separating roller 53, a cooling fan 56 located inside of the fixing belt 57 between the fixing roller 51 and the separating roller 53, for air-cooling the fixing belt in a part between the fixing roller 51 and the separating roller 53, and the like.

The fixing roller 51 has a concentric three-layer configuration composed of a core part, an elastic layer and a mold parting layer. The core part is formed of a hollow aluminum pipe having a diameter of about 44 mm and a thickness of about 5 mm, the elastic layer is made of a silicone rubber having a JIS-A hardness of 50 deg. and a thickness of about 3 mm, and the mold parting layer is made of PFA having a thickness of about 50 μm. A halogen lamp (not shown) as a heat source (roller heating heater) is accommodated in the hollow pipe space 58 of the core part.

The press roller 52 has a configuration similar to the above-mentioned fixing roller 51. Another halogen lamp (not shown) as a heat source (roller heating heater) is accommodated in a hollow pipe space 59 of a core part in the press roller 52.

The fixing roller 51 and the press roller 52 are made into press contact with each other by a predetermined pressure through the intermediary of the fixing belt 57 interposed therebetween so as to constitute a fixing nip portion N having a predetermined width and serving as a heating and pressing portion.

Further, the fixing belt 57 has a double-layer structure incorporating a mirror surface-like mold parting layer at its front surface (which is brought into contact with the recording medium P and the press roller 52) as a smooth surface member, and a base at a rear surface (which is brought into contact with the fixing roller 51). This mold parting layer is formed of a PFA having a thickness of 30 μm, and the base is formed of a polyimide film having a thickness of 100 μm.

The fixing roller 51 is rotated in the clockwise direction as indicated by the arrow at a predetermined speed by a drive mechanism which is not shown. The rotation of the fixing roller 51 causes the fixing belt 57 to rotate in the clockwise direction indicated by the arrow. The separating roller 53, the tension roller 54, the press roller 52 and the auxiliary roller 55 are driven to rotate in association with the rotation of the fixing belt 57. The tension roller 54 is adapted to apply a predetermined degree of tension to the fixing belt 57.

Power is supplied to the halogen lamps which are accommodated respectively in the fixing roller 51 and the press roller 52. The interiors of the fixing roller 51 and the press roller 52 are heated by heats from the halogen lamps. Accordingly, the surface temperatures thereof are increased, and are detected respectively by thermistors which are not shown. Thus detected temperatures are fed back to a control circuit which is not shown, from the thermistors. The control circuit controls the powers fed to the halogen lamps so that the detected temperatures delivered from the thermistors are maintained at predetermined temperatures which have been set for the fixing roller 51 and the press roller 52, respectively. That is, the fixing roller 51 and the press roller 52 are thermally controlled respectively to the predetermined temperatures so as to control the temperature of the nip portion N to a predetermined fixing temperature.

The recording medium having been conveyed from the transfer belt mechanism D to the belt fixing unit F and having an unfixed toner image on its surface is introduced between the fixing belt 57 and the press roller 52 in the fixing nip portion N where it is held therebetween and is conveyed. The surface of the recording medium P which bears thereon the unfixed toner image is faced to the front surface of the fixing belt 57. During the conveyance of the recording medium P held between the fixing belt 57 and the press roller 52 through the fixing nip portion N, it is heated and pressed so as effect color mixture and fixing (fixation) onto the recording medium P. At the same time, the recording medium P is brought into close contact with the front surface of the fixing belt 57. Thereafter, the recording medium P is conveyed being brought into close contact with the fixing belt 57, through a cooling zone R between the fixing nip portion N and the separating roller 53 in association with the rotation of the fixing belt 57. The recoding medium P is subjected to effective forced cooling in the cooling zone R under action of air flowing through the cooling fan 56 and a duct **56*a* surrounding the former. There is caused an airstream orthogonal to the sheet surface of the figure by the cooling fan 56**.

The recording medium P brought into close contact with the front surface of the fixing belt 57 is sufficiently cooled in the cooling zone R, and comes to the position of the separating roller 53. Thus, the recoding medium P is separated from the front surface of the fixing belt 57 in a zone in which the curvature of the fixing belt 57 is changed by the separating roller 57, due to the stiffness of the recording medium itself (separation through curvature).

The auxiliary roller 55 is adapted to prevent occurrence of such a problem that the recording medium P comes off from the front surface of the fixing belt 57 on the way of the fixing belt cooling zone R from the fixing roller 51 to the separating roller 53, resulting in disturbance of an image on the recording medium P or impossible conveyance of the recording medium P.

In the case of using a recording medium having, at its front surface, a glossy layer such as a transparent resin layer, as the recording medium, in order to produce a glossy image bearing product, the temperature of the glossy layer is increased by heat from the fixing nip portion N. Accordingly, the glossy layer is softened during conveyance of the recording medium held between the fixing belt 57 and the fixing roller 51. Accordingly, toners are embedded in the glossy layer at a high temperature through the application of pressure in the fixing nip portion. Simultaneously, the recording medium is brought into close contact with the front surface of the fixing belt 57. Thereafter, the recording medium P is conveyed being made into close contact with the fixing belt 57, through the cooling zone R in association with the rotation of the fixing belt 57. Accordingly, the recording medium P is forced to be sufficiently and effectively cooled. Further, the recording medium P is separated from the fixing belt 57 in a zone where the curvature of the fixing belt 57 is changed by the separating roller 53.

(3) Glossy Image Forming Mode

In the glossy image forming mode, a recording sheet formed on its front surface with a glossy layer (image receiving layer or an receptor layer) is used as the recording medium P. The glossy layer which will be hereinbelow detailed is made of resin (thermoplastic resin) having such a characteristic that it is melted together with the toner at a usual fixing temperature, being heated at a usual fixing temperature by the fixing unit, or is fused together with the toners at a normal fixing temperature.

A general structure of the recording medium P having, on its front surface, a glossy layer is composed of a base having, on its at least one surface, a pigment coating layer containing an adhesive or a pigment as a main component, and a resin layer formed on the pigment coating layer and containing thermoplastic resin as a main component, as a glossy layer.

Although the above-mentioned resin layer containing thermoplastic resin and thermosetting resin as the main components is used, a mixed resin layer in which thermoplastic resin and thermosetting resin are mixed may also be used. Further, it may be formed of a plurality of layers including a thermoplastic resin layer containing thermoplastic resin as a main component and a thermosetting resin layer containing thermosetting resin as a main component. It is noted here that the topmost layer of the plurality of layers constituting the above-mentioned resin layer should be a thermosetting resin layer containing thermosetting resin as a main component. The configuration of layers in the combination of the mixed resin layer, the thermoplastic layer and the thermosetting layer may be used, including the topmost layer such as the mixed resin layer, the thermosetting resin layer or the like containing the thermosetting resin.

As the thermoplastic resin, there may be preferably be used polyester resin, styrene-acrylic ester, styrene methacrylic acid ester, or the like among which the polyester resin is in particular preferable.

As to the glossy image bearing product, the smoother the surface of the recording medium after image formation, the higher the glossiness or the higher the quality of the image. Thus, there may be prepared a recording medium having a surface which has been previously smooth, as the recording medium, but should the smoothness of the surface be increased, there may possibly caused such a problem of conveyance that double feed or inferior pick of recording mediums is caused when a single recording medium is picked up and fed from a paper feed potion such as a cassette for recording mediums. It has been known that the so-called coated sheet coated thereover with a pigment coating layer containing an adhesive and a pigment as the main components also causes this problem. In particular, conveyance of recording sheets having both surfaces coated is very difficult.

Even a recording medium having, on its surface, a smooth glossy layer also causes this problem. In particular, a recording medium having opposite surfaces smoothened and respectively covered with glossy layers severely causes this problem. This is similar even with a double-surface coated sheet having one of opposite surfaces covered with a glossy layer and the other one thereof covered with a pigment coating layer.

Thus, in this embodiment, as a recording medium having a glossy surface layer, which is used during a glossy image forming mode, there may be used a recording medium (having a glossy layer with a roughened surface) comprising a glossy layer having an outer surface with slight unevenness and without being previously smoothened so as to substantially prevent occurrence of a problem during pick-up and conveyance of a single sheet of the recording medium.

Figure 4A:
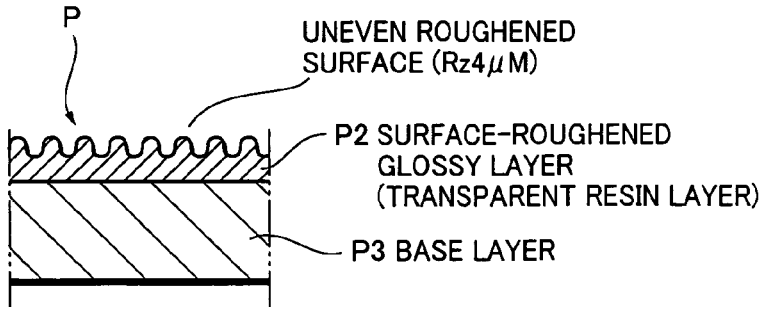
FIGS. 4A to 4E are schematic sectional views illustrating toner images in various conditions after fixation in the case of using a recording medium having a roughened glossy surface.

Specifically, as shown in FIG. 4A, there is used a recording medium P in which a 170 g/m$^2$ coated sheet (base) P1 is covered on its one surface with, as a glossy layer (resin layer), a transparent resin layer P2 (which will be referred to as "glossy layer") containing polyester (thermoplastic resin) as a main component, the glossy layer P2 having a surface roughness of Rz 4 μm (specified by JIS Standards).

Thus, with the recording medium having the glossy layer P2 which has been previously surface-roughened, it is possible to prevent occurrence of inferior pick-up from the paper feed cassette. That is, several sheets of the recording medium P stored in the paper feed cassette can be properly separated and conveyed to the image forming portion, one-by-one.

In the apparatus of this embodiment, in consideration of the capability of separation, conveyance and smoothening of the recording medium, the surface-roughness Rz (specified by JIS Standards) of the glossy layer before smoothening is preferably set to be higher than 2 μm but not greater than 10 μm. The various components of a smoothening means (fixing means) are preferably set so that the surface-roughness Rz of the glossy layer P2 which has been surface-roughened becomes 2 μm after smoothening.

The surface-roughened glossy layer P2 of the recording medium as mentioned above is smoothened so as to have a surface-roughness of Rz=about 1 μm by a surface-smoothening process which will be explained hereinbelow.

Should the surface of the glossy layer of the recording medium be originally not smooth, the belt fixing unit F would have to apply a relative high pressure and heat to the recording medium in order to allow the glossy layer thereof to have a desired smoothened surface. That is, the lower the smoothness of the surface of the glossy layer of the recording medium before image information, the higher the required heat and pressure in the fixing portion, a toner image and a resin layer as the glossy layer should be subjected to the correspondingly high heat and pressure. That is, excessive heat and pressure causes problems, such that toners are excessively melted away and are therefore offset onto the fixing belt, or flow over the recording medium. This results in blurring of an image, and further, the toner image is misaligned together with the resin layer as the glossy layer, resulting in disturbance of the image. Accordingly, in the case of lower smoothness of the surface of the glossy layer of the recording medium before image formation, it is self-explanatory that an increase in heat and pressure of the fixing portion for allowing the glossy layer to have a desired surface roughness should be limited. Thus, there are possibly caused problems of an occurrence of height difference of toner, occurrence of blurring of an image, lowering of glossiness and the like.

Figure 4B:
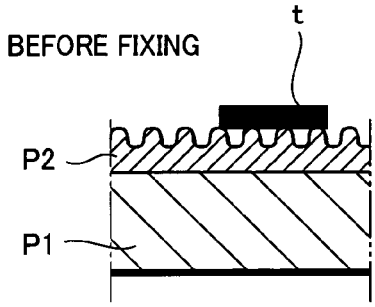
Figure 4C:
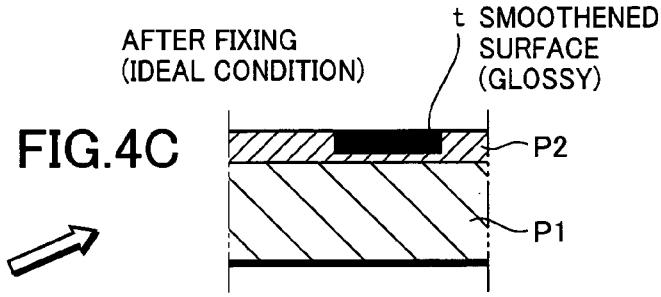
Figure 4D:
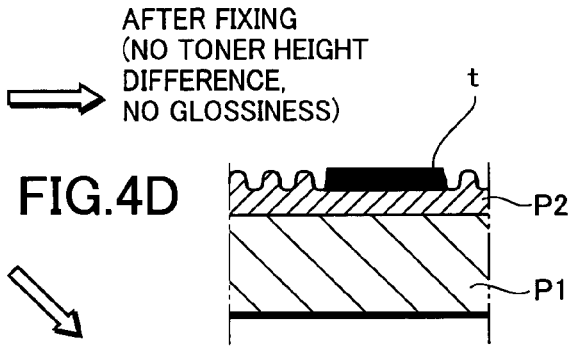
Figure 4E:
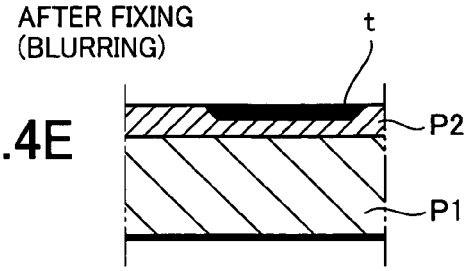

An explanation will be made of these problems with reference to FIGS. 4B to 4E. In a condition before fixing, as shown in FIG. 4B, an unfixed toner image t transferred onto the recording medium P having the surface-roughened glossy layer P2 has a height from several μm to several tens μm. The belt fixing unit F in this embodiment aims at completely fusing the toner image t into the transparent resin layer P2 as the glossy layer so as to be smoothened together with the transparent resin layer P2 in order to obtain a high glossy image, as shown in FIG. 4C. However, should the heat be insufficient, as shown in FIG. 4D, the toner image t would not be sufficiently fused into the transparent resin layer P2, resulting in residual height difference, or the surface of the transparent resin layer P would not be sufficiently melted so as to become unsmooth, resulting residual unevenness. Thus, there has been caused a problem of no glossiness, Further, since overheating would cause the toner image t to excessively collapse as shown in FIG. 4E, the image would be widened so as to result in blurring of the image (blurred image).

In view of the above, the image formation was carried out in various conditions in which the fixing speed of the belt fixing unit F, the temperature of the fixing roller and the temperature of the press roller were changed. Therefore, the problems of toner height difference, blurring of image and glossiness of recording medium were evaluated by their degrees. Thus obtained results are shown in Table 1:

TABLE 1

| Fixing Speed (mm/s) | Fixing Roller Temp. (deg. C.) | Toner Height Difference | Image Blurring | Recording Medium Glossiness |
|---|---|---|---|---|
| 50 | 140 | X | ○ | X |
| 50 | 160 | ○ | ○ | Δ |
| 50 | 180 | ○ | X | ○ |
| 70 | 140 | X | ○ | X |
| 70 | 160 | Δ | Δ | Δ |
| 70 | 180 | ○ | Δ | ○ |
| 90 | 140 | Δ | ○ | X |
| 90 | 160 | X | ○ | X |
| 90 | 180 | X | Δ | Δ |

In the evaluation, ○ indicates to be satisfactory, Δ insufficient, and × unsatisfactory. As understood from the above-mentioned results, in a condition in which glossiness of the surface of the recording medium is obtained, the toners are excessively melted so as to cause the image to blur.

Thus, in this embodiment, among several image forming modes, a desired one, for example, a glossy image forming mode or a double-surface glossy image forming mode, is selected and designated as follows:

With the provision of a mode selection key in an operation panel (liquid display panel) provided in the upper part of the image forming apparatus, the operator depresses the mode selection key in order to select a desired mode so as to carry out, for example, a glossy image forming mode.

Further, with the provision of a paper feed cassette key in the operation panel, a paper feed cassette stored therein with recording mediums formed thereon with a glossy layer may be registered by means of the operation panel. That is, the operator depresses the paper feed cassette key which has been previously registered, and accordingly, for example, the glossy image forming mode is automatically selected and carried out.

Further, with the provision of a recording medium determining means in the recording medium conveying path, there may be provided such a configuration that the recording medium determining means automatically detects a kind of a recording medium fed from the paper feed portion, and having a glossy layer, then a control circuit in the image forming apparatus recognizes a result of the detection, and accordingly, a desired mode, for example, the glossy image forming mode is carried out in accordance with the recognition.

In the case of using the image forming apparatus as a printer which is connected in a network to a host computer such as a personal computer through an intermediary of a LAN cable, a signal delivered from the host computer, for selecting and designating an image forming mode is received by an interface as an input means for the image forming apparatus by way of the network, and is then recognized by a CPU. Accordingly, a desired image forming mode, for example, the glossy image forming mode is automatically carried out.

Next, an explanation will be made of a series of process steps in the glossy image forming mode (Refer to a flowchart shown in FIG. 7 as necessary).

When the glossy image forming mode is selected, 1) a recording medium P having a surface-roughened glossy layer P2, as shown in FIG. 5A, which does not cause any problem in view of separation and conveyance of a single sheet of the recording medium P from the paper feed portion is used as a recording medium having, on its surface, a glossy layer;

2) it is fed from the paper feed portion and introduced into the first to fourth image forming portions Pa, Pb, Pc, Pd, but at this stage, it is merely passed by the image forming portions without forming an fixed toner image, and is sent into the belt fixing unit F which is used as a surface smoothening means for smoothening the surface-roughened glossy layer P2 with heat and pressure by the belt fixing unit F and with the use of the fixing belt 57 as a smoothening means so as to obtain the recording medium P as shown in FIG. 5B.

3) the recording medium P having the surface-smoothened glossy layer P2 is reintroduced into the image forming portions Pa, Pb, Pc and Pd so as to form an unfixed toner image t on the surface of the surface-smoothened glossy layer P2, as shown in FIG. 5C;

4) the recording medium P is reintroduced into the belt fixing unit F for fixing the toner image onto the recording medium P. At this stage, the glossy layer P2 is heated together with the toner image by the fixing unit F (about 180 deg. C.) so as to be melted. Thereafter, they are cooled down to a predetermined temperature (about 50 deg. C.). Thereafter, the recoding medium is separated from the fixing unit F (fixing belt). As a result, a high glossy image comparable with a silver lead photograph is formed on the recording medium. Thereafter, the recording medium is discharged outside of the image forming apparatus F, onto, for example, a paper discharge tray.

At the above-mentioned item 4), the toner image t is fixed being embedded in the transparent resin layer P2 of the recording medium P, and both transparent resin layer P2 and toner image t on the recording medium are solidified following the configuration of the front surface of the fixing belt 57. Thus, the recording medium is smoothened over its entire surface, and accordingly, a high glossy color image can be obtained. In this embodiment, the front surface of the fixing belt is mirror-surfaced in view of this point.

Further, in the above-mentioned items 2) and 3), after the surface-roughened glossy layer P2 is smoothened with no toner image by the belt fixing unit F as a surface smoothening means, the recording medium P2 is reintroduced into the image forming portions Pa, Pb, Pc, Pd in the manner as follows:

The recording medium P coming out from the belt fixing unit F as the surface smoothening means is led through a path having been changed toward the reverse refed mechanism H by the selector 10 which has been turned into the second posture, and is prevented by the second selector 16 from being directed toward the reversing portion (switch back mechanism) 13, so as to be directed toward the double surface conveying path 14 with no reversal of the recording medium onto the back side in order to be once stored in the intermediate tray 15.

Further, the recording medium stored in the intermediate tray 15 is fed to the registration roller 8 therefrom by the paper feed rollers which are driven with a predetermined control timing, and is then again fed onto the transfer belt 71 of the transfer belt mechanism D from the registration roller 8.

Thus, with the use of the recording medium P having the surface-roughened glossy layer P2 as a recording medium for forming a glossy image, the topmost sheet of several sheets of the recording medium P stored in the paper feed cassette can be surely separated and fed with no double feed, thereby it is possible to ensure satisfactory separation and conveyance of the recoding medium.

It is noted that no consideration to image inferiority, such as blurring or disturbance of a toner image is required as to the condition of previously surface-smoothening the surface-roughened glossy layer P2 of the recording medium P, including heat, pressure and conveying speed of the recording medium in the belt fixing unit F since no toner image is formed. Accordingly, it is possible to set a condition with which only the surface-roughened glossy layer P2 of the recording medium P is sufficiently smoothened as a main purpose.

That is, the surface-smoothening condition can be set, irrespective of a fixing condition of the belt fixing unit F for fixing the recoding medium having a surface-smoothened glossy layer carrying thereon a toner image, thereby it is possible to selectively set a surface-smoothening condition for sufficiently applying heat and pressure which are required for allowing the surface of the surface-roughened glossy layer P2 to have a desired smooth surface.

Meanwhile, a fixing condition of the belt fixing unit F for fixing an unfixed toner image onto the recording medium P after surface-smoothening, is set to so as to prevent occurrence of a fault which would be caused if heat and pressure are set to high values required for surface-smoothening since the glossy layer P2 has been surface-smoothened. That is, as shown in FIGS. 5C to 5D, it is sufficient to set the condition to such that the toner image t is fused into the glossy layer P2 so as to be fixed and smoothened together with the glossy layer P2 in order to obtain a glossy image.

It is noted that the recording medium P can be preheated during surface-smoothening, according to the configuration of this embodiment. Accordingly, it is possible to enable the glossy layer P2 to be easily melted during fixation. Thus, there can be offered such a merit that the fixing condition becomes more flexible.

Further, according to the configuration of this embodiment, moisture in the recording medium can be previously vaporized during surface-smoothening; thereby it is possible to constrain image inferiority such as disturbance of a toner image caused by water vapor during fixing.

Thus, in this embodiment, the heating condition during surface-smoothening by the belt fixing unit is set to be greater than the heating condition during fixing, that is, the heat value applied to the recording medium is increased. It is noted that pressure applied to the recording medium is not altered between smoothening and the fixing.

Specifically, the smoothening condition of the belt fixing unit F during fixing is such that the fixing speed is set to 50 mm/sec (a running speed of the fixing belt) and the fixing temperature is set to 180 deg. C. (the temperature of the fixing roller), and meanwhile, the fixing condition of the belt fixing unit during fixing is such that the fixing speed is set to 50 mm/sec and the fixing temperature is set to 160 deg. C. With these settings, it is possible to obtain a satisfactory high glossy toner image with no image inferiority such as toner height difference and image blurring.

It is noted that the fixing speed (the conveying speed of the recording medium) may be set to be lower during surface-smoothening than during fixing so as to increase the heat value per unit time which is applied to the recording medium, without changing the fixing temperature, as to the conditions of the surface-smoothening and fixing by the belt fixing unit.

Further, it is preferable to set pressure applied to the recording medium so as to be higher during surface-smoothening than fixing. With this configuration, even a recording medium having a large surface-roughness can be properly surface-smoothened, and as well image inferiority can be prevented from occurring during fixing.

(4) Double Surface Glossy Image Forming Mode

Next, an explanation will be made of a double-surface glossy image forming mode for forming glossy images on both front and rear surfaces of a recording medium with the use of a recording medium P having both front and rear surfaces which are formed thereon with surface-roughened glossy layers P2, P2, respectively, as shown in FIG. 5E.

In the belt fixing unit of this embodiment, since the surface of a recording medium which is made into close contact with the fixing belt so as to be heated and cooled thereby can be surface-smoothened, this recording medium is fed twice to the belt fixing unit in order to surface-smoothen the surface-roughened glossy layers P2, P2 which are formed respectively on both front and rear surfaces of the recording medium, before image formation is carried out on both surfaces thereof.

An explanation will be hereinbelow made of a series of steps of the double surface glossy image forming mode (Refer to the flowchart shown in FIG. 7 as necessary). It is noted that the functions and configurations of the members are the same as those explained in the glossy image forming mode as stated above.

If the glossy image forming mode is selected as an image forming mode, and then, the double-surface glossy image forming mode is selected;

1) with the use of the recoding medium P having surface-roughened glossy layers P2, P2 which do not cause any problem during separation and conveyance of a single recording medium from the paper feed portion, as shown in FIG. 5E, 2) it is introduced from the paper feed portion to the first to fourth image forming portions Pa, Pb, Pc, Pd, but it is passed by the image forming portions without forming an unfixed toner image, and is then led to the belt fixing unit F. Further, with the use of the belt fixing unit F as a surface-smoothening means, one of the surface-roughened glossy layers P2 is heated and pressed by the belt fixing unit F, and surface-smoothened by the fixing belt 57 as a means for surface-smoothening (in a condition shown in FIG. 5B).

3) after the recoding medium having one of surface-roughened glossy layers which has been surface-smoothened is reversed upside down, it is reintroduced into the first to fourth image forming portions Pa, Pb, Pc, Pd by which it is also passed without forming an unfixed toner image and is led to the belt fixing unit F. Further, the other one of the glossy layers P2 is surface roughened by heating and pressing with the belt fixing unit F (in a condition shown in FIG. 5B).

4) The recording medium having, on both surfaces, the surface-roughened layers which have been surface-smoothened is again introduced into the image forming portions Pa, Pb, Pc, Pd without being reversed upside down. Accordingly, an unfixed toner image t is formed on the other one of the surface-roughened glossy layers P2 of the recording medium (in a condition shown in FIG. 5C)

5) The recording medium P is again introduced into the belt fixing unit F which therefore fixes the other one of the surface-roughened glossy layers P2 which has been surface-roughened (FIG. 5D).

6) The recording medium having the other one of the surface-smoothened glossy layers P2, which has been fixed, is reversed upside down, and thereafter is again introduced into the image forming portions Pa, Pb, Pc, Pd, and accordingly, an unfixed toner image t is formed on the one of the surface-smoothened layers P2 (in a condition shown in FIG. 5C).

7) The recording medium P is again introduced into the belt fixing unit F which therefore fixes one of the surface-smoothened glossy layers P2 (in a condition shown in FIG. 5D). As a result, high glossy images which are comparable to that of a silver lead photograph are formed on both surfaces of the recording medium. Thereafter, the recording medium is discharged onto the discharge tray. Thus, a series of steps of the image forging operation is completed.

It is noted that explanation has been made of such a configuration that the image formation is made on both front and rear surfaces of the recording medium after the front and rear surfaces of the recording medium are successively surface-smoothened in the above-mentioned double surface glossy image forming mode. In addition, both surfaces of the recoding medium may be alternately processed by carrying out the steps of surface-smoothening a first surface of the recording medium, forming an image on the first surface of the recording medium, surface-smoothening a second surface of the recording medium and forming an image on the second surface of the recording medium, in the mentioned order. However, this configuration causes the image fixed on the first surface of the recording medium to be affected by heat and pressure during surface-smoothening of the second surface of the recording medium. Accordingly, it is better to carry out the afore-mentioned configuration in which both front and rear surfaces of the recording medium are successively surface-smoothened, and then are formed thereon with images, successively.

Figure 7:
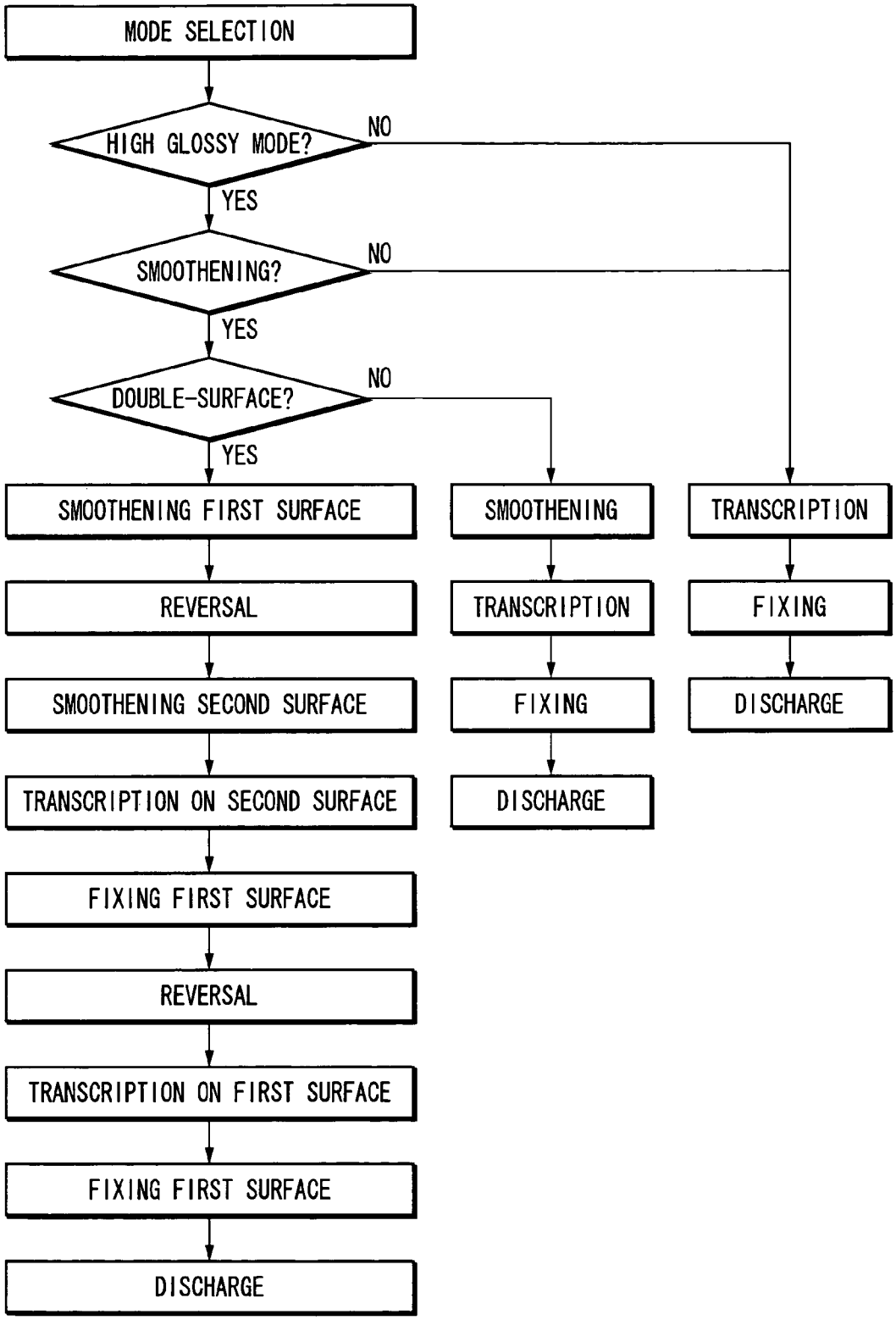
FIG. 7 is a flowchart for explaining a glossy image forming mode.

As shown by the flowchart in FIG. 7, it is noted that in the case of using a recording medium having, on its one surface, glossy layers P2 which are not sufficiently surface-roughened, and which are contrived so as to prevent occurrence of inferior pick-up, it is configured that a mode in which a series of usual image forming steps are carried out with no surface-smoothening can be selected and designated even though the glossy image forming mode is selected and designated.

Thus, it is possible to aim at enhancing the usability by preparing such a mode that the smoothening process is omitted so as to form a glossy image having a moderate quality which is though lower than the quality of the image obtained in the above-mentioned embodiment, for the user who worries about lowering of the productivity of images which are caused by the surface-smoothening process.

Embodiment 2

Although an explanation will be made of the image forming apparatus in the embodiment 1 in which the fixing belt 57 serving as a surface-smoothening means in the belt fixing unit F is composed of the polyimide base formed thereon with the PFA mold parting layer, in this embodiment, there is used an endless belt composed of stainless sheets (SUS) having a thickness of 100 μm, which are joined together, as the fixing belt 57. Since a metal surface of the metal belt can simply be mirror-surface polished, it can offer such a merit that a higher glossy image can be produced.

Also in this embodiment, an glossy image forming mode was carried out, similar to that in the image forming apparatus in the embodiment 1, a satisfactorily high glossy toner image could be obtained without image inferiority, such as toner height difference or blurring.

Embodiment 3

Figure 6:
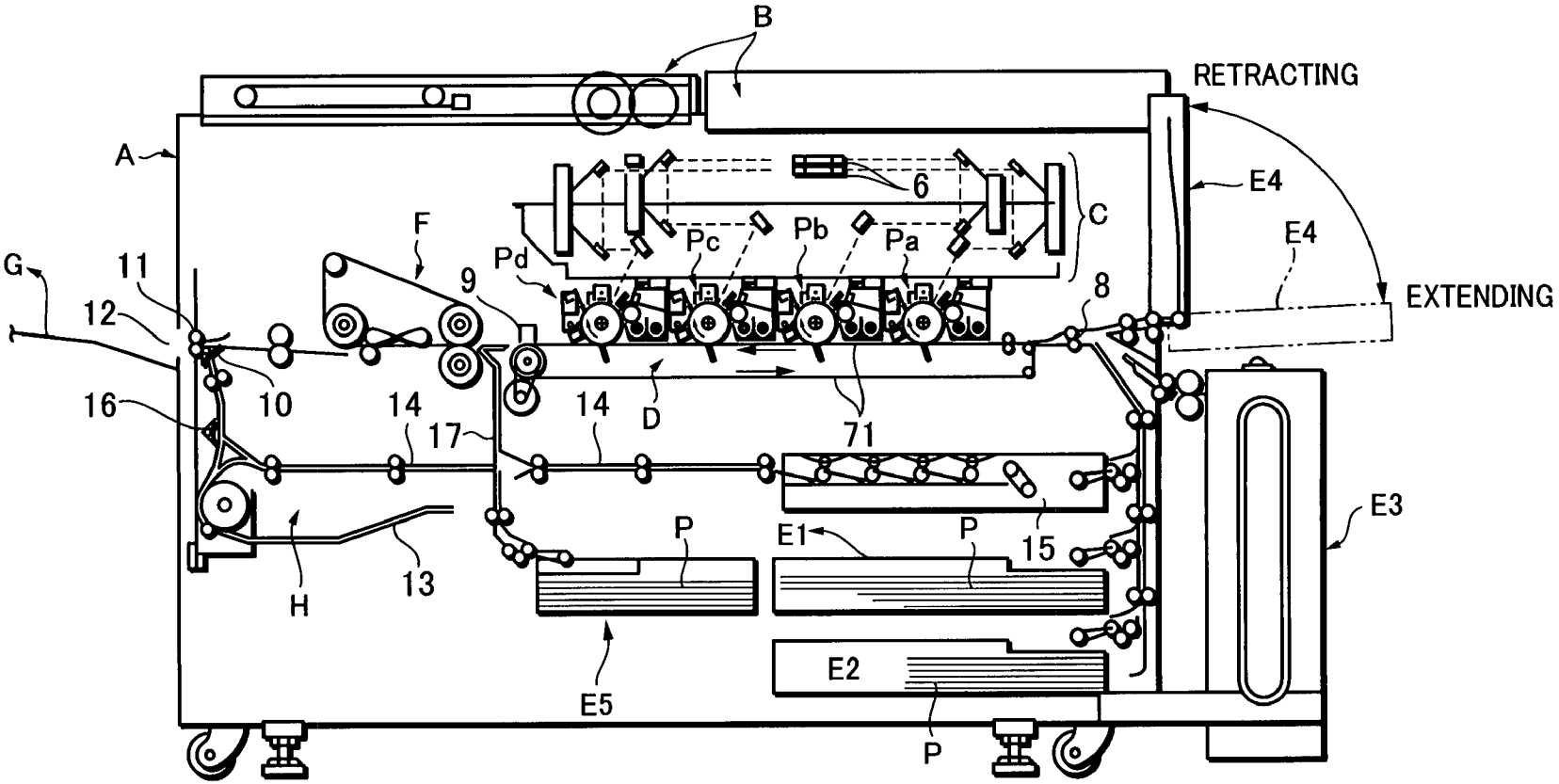
FIG. 6 is a schematic sectional view illustrating a basic configuration of an image forming apparatus in a third embodiment of the present invention.

FIG. 6 is a schematic sectional view illustrating a basic configuration of an image forming apparatus according to this embodiment. The configuration of this image forming apparatus in this embodiment is the same as that of the image forming apparatus in the embodiment 1 (which is shown in FIG. 1), except that a fifth paper feed portion E5 (paper feed cassette) as an exclusive paper feed portion for a recording medium P having a surface-roughened glossy layer, and a conveying path 17 exclusive for a surface-smoothening process, which introduces the recording medium P direct from the fifth paper feed portion 5E into the belt fixing unit F, bypassing the image forming portions Pa, Pb, Pc, Pd are provided. Thus, the configuration identical with that of the embodiment 1 will be omitted in order to avoid duplication of the explanation.

In this embodiment, if the glossy image forming mode is selected, the following steps are successively carried out. It is noted that a series of steps are similar to that explained with the use of the flowchart shown in FIG. 7, except that the conveying path 17 is used.

When the glossy image forming mode is selected, the control circuit as a control means operates paper feed rollers in the fifth paper feed portion E5 as an exclusive paper feed portion for the recording medium P having the surface-roughened glossy layer P2 so as to separate and feed the recording medium P solely.

The recording medium P is fed directly to the belt fixing unit F by way of the conveying path 17, by passing the image forming portions Pa, Pb, Pc, Pd.

Further, the surface-roughened glossy layer P2 of the recording medium P is heated and pressed by the belt fixing unit F as a surface-smoothening means, and accordingly, it is surface-smoothened as shown in FIG. 5B.

Thereafter, it is advanced toward the reversing refeed mechanism H after its way is changed over by the selector 10 which has been changed over into the second posture, and then, it is directed to the double-surface conveying path 15 with no upside down reversal of the recording medium P, without being directed to the reversing portion (switch-back mechanism) 13, by the second selector 16, and is once stored in the intermediate tray 15. Further, the recording medium stored in the intermediate tray 15 is fed out from the tray 15 to the registration roller 8 by the paper feed rollers which are driven with a predetermined control timing, and is then fed onto the transfer belt 71 in the transfer belt mechanism D.

Further, the recording medium is introduced into the image forming portions Pa, Pb, Pc, Pd so as to transfer an fixed toner image t onto the surface-smoothened glossy layer P1 of the recording medium, as shown in FIG. 5C. Then, it is reintroduced into the belt fixing unit F in order to fix the toner image t as shown in FIG. 5D, thereby it is possible to obtain a high glossy image bearing product.

In the image forming apparatus in this embodiment, which is provided with the fifth paper feed portion E5 as an exclusive paper feed portion for the recording medium P having the surface-roughened glossy layer P2, and the conveying path 17 for directly introducing the recording medium P from the fifth paper feed portion E5 to the belt fixing unit F, bypassing the image forming portions Pa, Pb, Pc, Pd, the recording medium can be fed to the fixing station for smoothening the surface of the recoding medium without passing through the image forming portions, resulting in a shortened time of conveyance of the recording medium. Accordingly, it is possibly to greatly increase the throughput.

Even in this embodiment, it is possible to provide an image forming apparatus which can produce a satisfactorily high glossy toner image without image inferiority, such as toner height difference or blurring.

In this embodiment, the fixing temperature as to the surface-smoothening condition for the fixing unit F as the surface-smoothening means for surface-smoothening the surface-roughened glossy surface P2 of the recording medium P with no toner image is set to be higher than the fixing temperature as to the fixing condition for the fixing unit F as the fixing means for fixing the recording medium having the surface-smoothened glossy layer P2 with a toner image. However, it goes without saying a configuration that the fixing change may be set to be equal but the fixing speed is set be different therebetween so as to cause the heating capacity to differ therebetween.

Variant Form

1) In the above-mentioned embodiments, although explanation has been made of the image forming apparatus which utilizes a multiple transcription system for forming an image, direct to the recording medium carried on the transfer belt, the present invention should not be limited to the above-mentioned embodiments, but may be applied similarly to an image forming apparatus of the so-called intermediate transcription type in which images on photosensitive drums as image carriers are once superposed with one another on an intermediate transfer member, and are then transferred onto a recording medium in a batch.

Further, the present invention can be applied not only for a color image forming apparatus but also for a monochromatic image forming apparatus. In addition to the transfer system, the present invention can be also applied to an image forming apparatus for forming a color image, a multi-color image or a monochromatic image on a surface of a recording medium with direct transcription.

2) Although an explanation has been made of the image forming apparatus in the above-mentioned embodiments in which the belt fixing unit F is additionally used as the surface-smoothing means for the recording medium P having the surface-roughened glossy layer P2, there also may be constituted an image forming apparatus having such a configuration that an exclusive surface-smoothening means for surface-smoothening the glossy layer P2 of the recoding medium is provided in addition to the belt fixing unit F.

3) Although an explanation has been made of the image forming apparatus in the above-mentioned embodiments in which the surface smoothening is carried out by using the belt, the present invention should not be limited to this configuration, but there may be used such a configuration that the recording medium may be heated and pressed by a pair of rollers. It is understood that the exclusively provided surface-smoothening means should not be limited to a belt-type heating and pressing device alone.

While the present invention has been described with reference to exemplary embodiments, it is to be understood that the invention is not limited to the disclosed embodiments. On the contrary, the invention is intended to cover various modifications and equivalent arrangements included within the spirit and scope of the appended claims. The scope of the following claims is to be accorded with the broadest interpretation so as to encompass all such modifications and equivalent structures and functions.

This application claims priority from Japanese Patent Application No.2004-166795 filed Jun. 4, 2004, which is hereby incorporated by reference herein.

What is claimed is:

1. An image forming apparatus comprising:

an image forming device configured and positioned to form a toner image on a toner reception resin layer of a recording medium;

a conveying device configured and positioned to convey the recording medium set on a setting portion to said image forming device; and a smoothening device configured and positioned to smoothen the toner reception resin layer of the recording medium on which the toner image is formed by said image forming device, said smoothening device including an endless belt for heating the recording medium in a nip portion and a cooling device for cooling the heated recording medium which is in contact with said endless belt before the recording medium is separated from said endless belt, wherein said apparatus is operable in a pre-smoothening mode in which the toner reception resin layer of the recording medium is smoothened by said smoothening device before the toner image is formed on the toner reception resin layer of the recording medium.

2. An image forming apparatus according to claim 1, wherein a heat amount per unit time applied to the recording medium is greater during a pre-smoothening process performed by said smoothening device than during a smoothening process performed by said smoothening device for the toner reception resin layer on which the toner image is formed.

3. An image forming apparatus according to claim 1, wherein pressure applied to the recording medium is higher during a pre-smoothening process performed by said smoothening device than during a smoothening process performed by said smoothening device for the toner reception resin layer on which the toner image is formed.

4. An image forming apparatus according to claim 1, wherein said smoothening device smoothens the surface of the recording medium by melting the toner reception resin layer.

5. An image forming apparatus according to claim 1, wherein said conveying device includes a separating roller for selectively separating one recording medium from a plurality of recording mediums, each medium having the toner reception resin layer, set on said setting portion to convey the one recording medium toward said image forming device and said smoothening device.

6. An image forming apparatus according to claim 1, wherein said conveying device includes a conveying path for conveying the recording medium, pre-smoothened by said smoothening device, toward said image forming device.

7. An image forming apparatus according to claim 1, wherein when the recording medium having the toner reception resin layer of which a surface roughness (Rz) is more than 2 μm but no more than 10 μm is set on said setting portion, said smoothening device performs smoothening so that the surface roughness (Rz) of the toner reception resin layer becomes equal to or less than 2 μm.

8. An image forming apparatus according to claim 7, wherein when the recording medium having the toner reception resin layer at both surfaces is set on said setting portion, said smoothening device performs smoothening so that the surface roughness (Rz) of the toner reception resin layers may become equal or less than 2 μm, respectively.

9. An image forming system comprising:

an image forming device which forms a toner image on a toner reception resin layer of a recording medium;

a smoothening device including a heating device which heats the recording medium in a nip portion and a cooling device which cools the heated recording medium which is in contact with the heating device before the recording medium is separated from the heating device so that the toner reception resin layer on which the toner image is formed of the recording medium is smoothened; and an executing device which executes a pre-smoothening mode in which the toner reception resin layer of the recording medium is smoothened by said smoothening device before the toner image is formed on the toner reception resin layer of the recording medium.

* * * * *

UNITED STATES PATENT AND TRADEMARK OFFICE

CERTIFICATE OF CORRECTION

PATENT NO. : 7,383,011 B2
APPLICATION NO. : 11/140740
DATED : June 3, 2008
INVENTOR(S) : Haruhiko Omata It is certified that error appears in the above-identified patent and that said Letters Patent is hereby corrected as shown below:

COLUMN 1:
Line 14, “have” should read --has--.
Line 65, “causes” should read --cause--.

COLUMN 2:
Line 19, “recoding” should read --recording--.
Line 25, “recoding” should read --recording--.
Line 26, “recoding” should read --recording--.

COLUMN 3:
Line 51, “an” should read --a--.
Line 52, “imager,” should read --image,--.

COLUMN 4:
Line 61, “which” should be deleted.

COLUMN 5:
Line 65, “recoding” should read --recording--.

COLUMN 6:
Line 22, “once” should be deleted; and “The” should read --Then, the--.
Line 48, “operated. Although” should read --operated, although--.

COLUMN 8:
Line 16, “recoding” should read --recording--.
Line 25, “recoding” should read --recording--.
Line 61, “an” should read --a--.

COLUMN 10:
Line 59, “resulting” should read --resulting in--.

UNITED STATES PATENT AND TRADEMARK OFFICE

CERTIFICATE OF CORRECTION

PATENT NO. : 7,383,011 B2
APPLICATION NO. : 11/140740
DATED : June 3, 2008
INVENTOR(S) : Haruhiko Omata It is certified that error appears in the above-identified patent and that said Letters Patent is hereby corrected as shown below:

COLUMN 12:
Line 26, “recoding” should read --recording--.
Line 28, “lead” should read --halide--.
Line 49, “refed” should read --refeed--.

COLUMN 13:
Line 2, “recoding” should read --recording--.
Line 15, “recoding” should read --recording--.

COLUMN 14:
Line 29, “recoding” should read --recording--.
Line 43, “recoding” should read --recording--.
Line 61, “therefore” should read --then--.

COLUMN 15:
Line 8, “lead” should read --halide emulsion--.
Line 19, “recoding” should read --recording--.
Line 45, “through” should be deleted.

COLUMN 16:
Line 49, “an” should read --a--.

COLUMN 17:
Line 27, “once” should read --first--.

Signed and Sealed this

Seventeenth Day of February, 2009

JOHN DOLL
*Acting Director of the United States Patent and Trademark Office*